US007235289B2

(12) United States Patent
Rancien et al.

(10) Patent No.: US 7,235,289 B2
(45) Date of Patent: Jun. 26, 2007

(54) PAPER INCLUDING BODIES CARRYING AT LEAST ONE BIOCHEMICAL MARKER

(75) Inventors: Sandrine Rancien, La Murette (FR); Sebastien De Lamberterie, Paris (FR)

(73) Assignee: Arjowiggins Security, Issy les Moulineaux (FR)

( * ) Notice: Subject to any disclaimer, the term of this patent is extended or adjusted under 35 U.S.C. 154(b) by 382 days.

(21) Appl. No.: 10/466,627

(22) PCT Filed: Jan. 18, 2002

(86) PCT No.: PCT/FR02/00209

§ 371 (c)(1),
(2), (4) Date: Jul. 18, 2003

(87) PCT Pub. No.: WO02/057548

PCT Pub. Date: Jul. 25, 2002

(65) Prior Publication Data

US 2004/0063117 A1 Apr. 1, 2004

(30) Foreign Application Priority Data

Jan. 22, 2001 (FR) ..... 01 00805

(51) Int. Cl.
*B32B 25/02* (2006.01)
*B32B 5/16* (2006.01)

(52) U.S. Cl. ..... 428/295.1; 428/296.1; 428/296.4; 428/298.7; 428/300.1

(58) Field of Classification Search ..... 428/113, 428/295.1, 296.1, 296.4, 298.7, 300.1; 435/176
See application file for complete search history.

(56) References Cited

U.S. PATENT DOCUMENTS

| | | | | |
|---|---|---|---|---|
| 3,583,358 | A * | 6/1971 | Hanson, Jr. | 116/235 |
| 4,619,842 | A * | 10/1986 | Moss et al. | 427/163.2 |
| 5,451,505 | A | 9/1995 | Dollinger | |
| 5,763,176 | A * | 6/1998 | Slater et al. | 435/6 |
| 5,869,160 | A * | 2/1999 | Mason et al. | 428/40.2 |
| 7,041,364 | B2 * | 5/2006 | Rancien | 428/211.1 |
| 7,153,557 | B2 * | 12/2006 | Rancien | 428/40.2 |

FOREIGN PATENT DOCUMENTS

| | | |
|---|---|---|
| WO | WO 94/04918 | 3/1994 |
| WO | WO 96/17954 | 6/1996 |

OTHER PUBLICATIONS

Thorsen et al., "Identification of biological/biochemical marker(s) for preterm delivery", Paediatric and Perinatal Epidemiology 2001, 15 (Suppl. 2), 90-103.*

* cited by examiner

*Primary Examiner*—H. Thi Le
(74) *Attorney, Agent, or Firm*—Oliff & Berridge, PLC

(57) ABSTRACT

Paper including bodies carrying at least one biochemical marker and of sufficient size to be capable of being taken individually.

31 Claims, 1 Drawing Sheet

PAPER INCLUDING BODIES CARRYING AT LEAST ONE BIOCHEMICAL MARKER

The present invention relates to novel paper.

The use of nucleic acids, in particular DNA, as authentication and/or identification means in order to enable various articles to be authenticated and/or identified is known from U.S. Pat. No. 5,763,176, amongst others.

In particular, it is known to incorporate microspheres having a diameter of about 0.01 micrometers (μm) to 5 μm in an ink for printing on an object, each microsphere carrying at least one nucleotide sequence. In order to identify the object, it is then necessary firstly to identify the microspheres using a suitable microscope, and then to take a sample of ink from the identified microsphere zone and purify it in order to extract the sequence of nucleotides, and then to amplify it by polymerase chain reaction (PCR) until a sufficient quantity has been obtained for analysis, amplification and analysis being performed using specific primers. The ink is generally removed by scratching, and that presents the drawback of damaging the object.

There exists a need for authenticating and/or identifying an object without performing destructive analysis of the object.

Such a need for authentication and/or identification exists in particular for paper intended for a variety of uses, in particular paper for serving as the medium of works of art or paper used in the manufacture of security documents, documents of value, or seals, for example passports, bank bills, or labels for placing on articles or packaging.

The invention seeks specifically to satisfy this need.

The invention thus provides novel paper, characterized by the fact that it includes bodies carrying at least one biochemical marker and of sufficient size to be capable of being taken individually.

The bodies used are preferably bodies having good affinity for paper, so as to remain secure therewith during the usual methods of transforming and using paper, in particular during printing.

The bodies carrying the biochemical marker are advantageously incorporated in the papermaking mass of fiber prior to the paper being delivered to end users.

The bodies carrying the biochemical marker can easily be extracted mechanically without spoiling the appearance of the paper, for example using tweezers, possibly while observing through a microscope.

In order to make them easier to remove, the largest dimension of said bodies is greater than 100 μm, and preferably of the order of one to a few millimeters (mm), for example lying in the range 1 mm to 10 mm.

The bodies used may be fibers or fiber agglomerates, such agglomerates possibly forming spots, which fibers may be natural, artificial, or synthetic.

The length of the fibers carrying the biochemical marker may lie, for example, in the range 3 mm to 10 mm, preferably being close to 5 mm.

The diameter or largest dimension of spots carrying the biochemical marker may be greater than 2 mm, for example.

When fibers are used, they may be made in numerous ways, depending on the nature of their main ingredients.

In particular, they can be made by spinning when they are essentially constituted by viscose, or by extrusion when they are made of a thermoplastic material such as polyamide or polyproylene.

The biochemical marker may be incorporated in the bodies that are to carry it in numerous ways, during or after manufacture of said bodies.

When said bodies are fibers, the biochemical marker may be incorporated in the material that is to constitute fibers prior to making the fibers by spinning or by extrusion, or after the fibers have been made by a dying or other method.

When the bodies are fiber agglomerates such as spots, the biochemical marker may be deposited on the paper that is to constitute the spots by a surface treatment, in particular using a size press or an impregnator.

The biochemical marker may also be chemically grafted to the fibers or other bodies used, with a strong chemical bond being established between the biochemical marker and the fiber or other bodies.

The bodies carrying the biochemical marker may optionally be colored, color making them easier to identify within the fiber mass of the paper.

The bodies carrying the biochemical marker may be colorless but may fluoresce in infrared or ultraviolet light, with fibers then being taken while they are under suitable lighting.

The bodies carrying the biochemical marker may be colorless in appearance but fluoresce with absorption and emission characteristics lying in the range 400 nanometers (nm) to 800 nm. The bodies are revealed under suitable lighting via an optical filter which selects fluorescent emission in a wavelength range lying in the visible. The optical principle of revelation by fluorescence in the visible range is described in greater detail in patent application PCT/FR01/02480, the content of which is incorporated herein by reference.

The bodies carrying the biochemical marker may be incorporated in the mass of the papermaking fiber in various ways.

The bodies carrying the biochemical marker may be scattered, in which case their distribution in the mass of papermaking fiber is random, or preferably they are applied in such a manner as to form a relatively narrow strip, thereby presenting the advantage of reducing the quantity of biochemical marker used.

The paper may include other security elements in addition to the bodies carrying the biochemical marker, such security elements constituting at least one additional means of authentication and/or identification.

The bodies carrying the biochemical marker may present other authentication properties, in particular they may be radioactive, magnetic, or indeed present properties of electromagnetic resonance at particular frequencies and/or they may change appearance depending on viewing angle or under the action of an excitation source such as a source of radiation.

The bodies carrying the biochemical marker may, in particular, contain microspheres that are detectable by epifluorescence microscopy, the microspheres being optionally bonded to the biochemical marker. The microspheres may be inorganic particles marked by specific fluorescence by a covalent bond, as described in patent application WO 01/30936.

The bodies carrying the biochemical marker may be constituted in particular by fibers that are fluorescent, thermochromic, or photochromic.

The density of the bodies carrying the biochemical marker may be very low, e.g. being less ten bodies per square decimeter ($dm^2$) of paper when the distribution of said bodies is random and covers all of the paper, or less than ten bodies per linear decimeter (dm) when the bodies are confined in a strip. Each body may include more than $10^7$ sequences, for example.

The biochemical marker may be buried in the material constituting said bodies, as mentioned above, or it may be present solely on the surface thereof, or it may be in both locations.

The biochemical marker is preferably buried in the material constituting the bodies, thereby protecting it against physical attack, in particular abrasion, or chemical attack, in particular substances for forgery.

When the biochemical marker is applied by surface treatment, it is preferably bound to the carrier body by a highly cross-linked binder in order to protect it, such a binder possibly being polyurethane cured by azidine or a styrene-acrylate copolymer cured with melamine-formol.

The biochemical marker used is preferably constituted by single strand sequences of at least 70 nucleotides, for example of at least 80 nucleotides. It is preferable to use at least $10^5$ such sequences per carrier body.

Such a biochemical marker provides a wide range of coding options and turns out to be extremely difficult to detect.

In order to be able to detect a DNA sequence having 70 to 110 nucleotides present in numbers of fewer than $10^{11}$ molecules requires "amplification" to be used. The term "amplification" designates the process which consists in duplicating DNA sequences by a polymerized chain reaction, commonly referred to by the abbreviation PCR.

To perform amplification of the sequence, it is necessary to have at least one primer (a strand of DNA complementary to one of the ends of the sequence that is to be amplified).

In the absence of such a primer, amplification cannot take place, thus providing means serving to limit access to detecting the DNA sequence.

The sequence may comprise a run of nucleotides encoding identification information, in addition to the run of nucleotides complementary to the above-mentioned primer.

One means for authenticating the DNA may advantageously be to use specific fluorimetric probes which, by hybridizing with a central region of the PCR-duplicated sequences, emits a fluorescent signal which can be measured by a laser. The intensity of the fluorescent signal is correlated to the number of amplified sequences. The advantage of this technique is that it makes it possible in real time to validate amplification which is then referred to as quantitative amplification.

The single strand sequences of at least 70 nucleotides that are used are preferably sequences made in accordance with the teaching of patent application WO 00/61799 so as to be suitable for amplification and detection by quantitative PCR.

Other biochemical markers can be used, in particular natural double-strand DNA or molecular semaphores.

The invention also provides a method of manufacturing paper, the method including the step consisting in incorporating bodies, in particular fibers, in the mass of papermaking fiber, which bodies carry at least one biochemical marker.

The bodies carrying the biochemical marker may be introduced into the bulk of the fiber or may be applied by surface treatment.

In particular, said bodies may be mixed in a bath, in particular an impregnating bath of a size or coating press as is used during treatment of the mass of papermaking fibers.

The bodies may be spread over the entire width of the papermaking machine, or over a fraction only thereof.

When the said bodies are constituted by extruded fibers, the biochemical marker is advantageously introduced into the master mixture used during extrusion.

The invention also provides a method of authenticating and/or identifying paper in which bodies carrying at least one biochemical marker have been incorporated during the papermaking process, the method comprising the step consisting in identifying and taking from the paper at least one body carrying the biochemical marker.

When the biochemical marker is a single strand sequence of nucleotides, the method may further include the step consisting in separating the sequences from the matrix of the body to which they are attached or incorporated, the matrix of the body being the material that constitutes the body. The step of separating the matrix and the DNA sequences is referred to as the step of extracting and purifying the DNA. When the biochemical marker is incorporated in the matrix of the body, marker extraction may include a step of dissolving the matrix of the body by means of one or more suitable solvents.

When the biochemical marker is a single strand sequence of nucleotides, the method may include the step of authenticating DNA by PCR using specific primers.

By performing quantitative amplification using specific primers and specific fluorimetric probes, it is possible in real time to validate amplification and to identify the amplified DNA. The paper is then identified.

When amplifying by means of non-quantitative PCR, the amplification may be followed by analysis, e.g. by sequencing, in order to identify the DNA sequence that was introduced into the paper.

The invention also provides fibers or spots including at least one biochemical marker, preferably at least one sequence of nucleotides, advantageously a single strand sequence comprising at least 70 nucleotides, and in particular at least 80 nucleotides.

Other characteristics and advantages of the present invention appear on reading the following detailed description of non-limiting embodiments, and on examining the accompanying drawing, in which.

Figure 1:
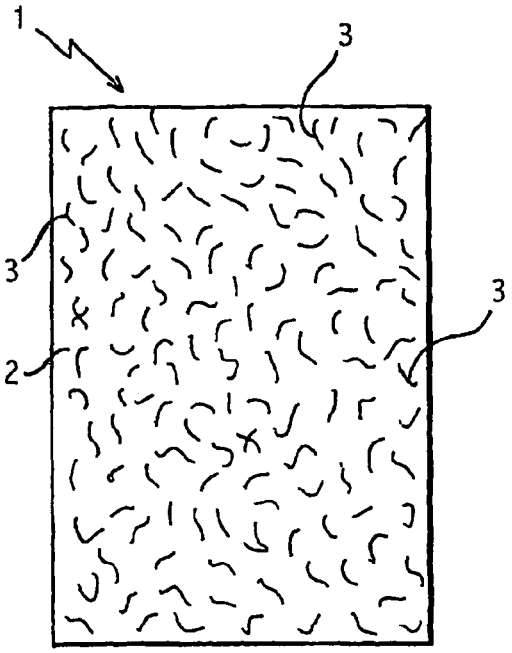
FIG. 1 is a diagrammatic front view of paper constituting a first embodiment of the invention.
Figure 2:
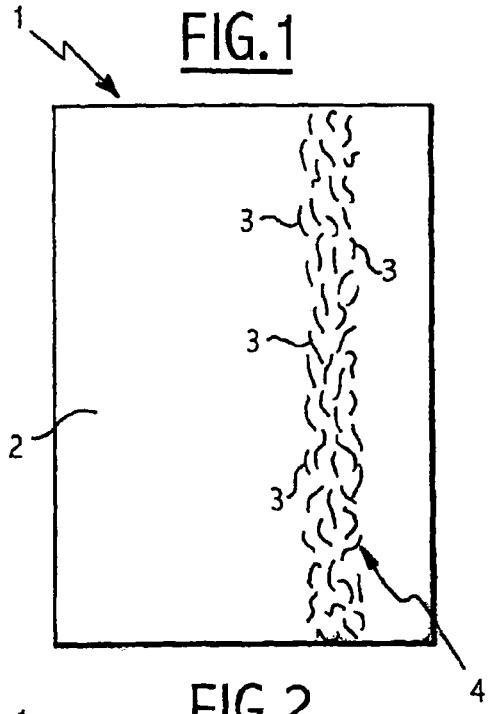
FIG. 2 is a diagrammatic front view of paper constituting a second embodiment of the invention.
Figure 3:
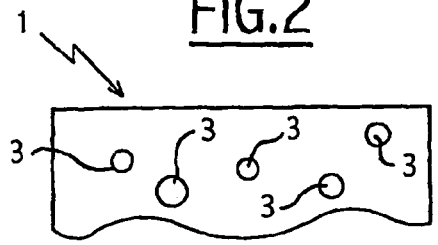
FIG. 3 is a diagrammatic and fragmentary front view of paper including spots coated in a biochemical marker.

FIGS. 1 to 3 show a sheet of paper 1 in accordance with the invention, comprising a mass of papermaking fibers 2 essentially constituted by cellulose fibers, for example, and a plurality of bodies 3, each carrying a specific biochemical marker as described in greater detail below.

In FIGS. 1 and 2, the bodies 3 are constituted by fibers, whereas in FIG. 3 they are constituted by spots.

In the example of FIGS. 1 and 2, the mean length of the fibers 3 is 5 mm, their diameter is 25 μm, and their specific gravity is close to 1.

In the example of FIG. 1, they are distributed randomly over the surface of the mass of papermaking fiber 2.

In contrast, in the example of FIG. 2, the fibers 3 are confined in a restricted zone of the width of the paper, thus forming a relatively narrow strip 4.

The fibers 3 may be made by spinning, mainly from viscose, for example, or by extruding polypropylene, for example, it naturally being possible also to use other materials and other methods of manufacture.

In the example shown, the biochemical marker is constituted by sequences 5 of nucleotides.

Figure 4:
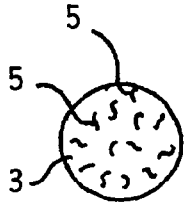
FIGS. 4 and 5 are cross-sections through two examples of fibers each carrying a biochemical marker.
Figure 5:
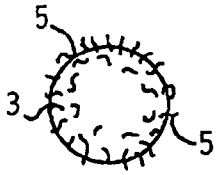

These sequences 5 are shown enlarged in FIGS. 4 and 5 which are not to scale. Where appropriate, they may be bonded to microspheres, as described in U.S. Pat. No. 5,763,176.

For each body 3, the sequences 5 may be dispersed throughout the bulk of the body 3, or on its surface, or in both locations.

In the example described, each body 3 has about $10^5$ to about $10^8$ sequences, with each sequence 5 being constituted by a single strand of DNA preferably comprising 70 to 110 nucleotides, e.g. 80 to 100 nucleotides.

Examples of biochemical markers comprises nucleotide sequences are given in U.S. Pat. No. 5,763,176 and in international patent applications WO 94/04918 and WO 00/61799, to which reference can usefully be made, such markers being marketed by the supplier Cypher Science, in particular.

The sequence 5 of nucleotides comprises in conventional manner a run of bases selected from the following list, for example: adenine A, cytosine C, guanine G, and thymine T, where thymine may be replaced by uracil, it being possible, where appropriate, to use other compounds and derivatives of nucleotides.

Figure 6:
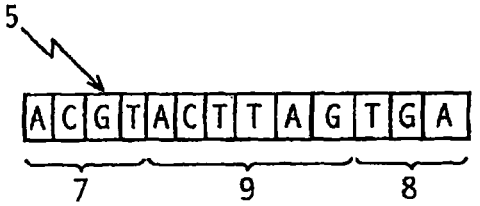
FIG. 6 is a diagram showing a sequence of nucleotides serving as a biochemical marker.

FIG. 6 is a diagram showing a sequence 5 having end regions 7 and 8 each constituted by a predetermined run of bases, and a central region 9 constituting the sequence carrying the identification information.

The end regions 7 and 8 are for recognition by complementary primers during PCR amplification, and they comprise 20 to 25 bases each, for example.

Only three or four bases are shown in FIG. 6 in order to clarify the drawing.

By way of example, the central region 9 comprises 30 to 60 bases and a portion thereof is intended to be recognized by specific fluorimetric probes. Only six bases are shown in order to simplify the drawing.

The bodies 3 may be incorporated in the paper in various ways, depending on the distribution desired for the bodies 3 over the surface of the paper.

They may be mixed in a bath used during the papermaking process, for example an impregnation bath of a sizing or coating press.

They may also be sprayed onto the surface of the paper.

Figure 7:
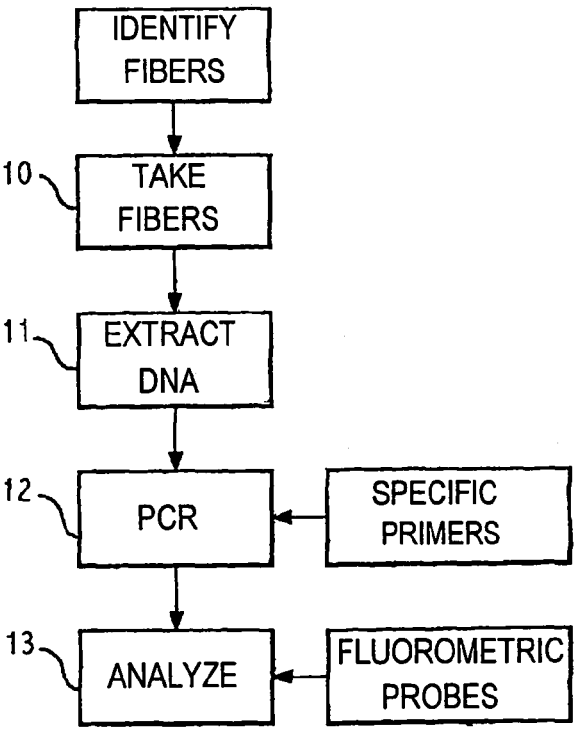
FIG. 7 is a block diagram showing the various steps in an identification method.

To authenticate and/or identify paper in accordance with the invention, the bodies 3 are initially identified and then taken in a step 10, as shown in FIG. 7.

The bodies may be taken optionally with the help of a microscope, e.g. by means of tweezers, without spoiling the appearance of the paper.

The number of bodies 3 that are taken can be very small, for example it can be equal to ten.

Once the bodies 3 have been taken, the matrices thereof are dissolved in a step 11 in order to extract the biochemical marker.

When the bodies 3 that are taken are made of viscose fibers, they can be placed in a bath of ethyl acetate which is warmed. As the ethyl acetate evaporates, solvent is added until the fibers have dissolved completely. Once dissolution is complete, a mixture of water and ethanol is added in order to precipitate the DNA.

When the bodies 3 that are taken are constituted by polypropylene fibers, they are placed, for example, in an extraction cartridge using Soxhlet extractor as marketed, for example, by the supplier Merck, which cartridges are used in conjunction with xylene.

The product of the dissolution is then purified, e.g. by using a purification kit bearing the trademark "DNeasy" sold by the supplier Qiagen. The purification process may consist in separating the biochemical marker from the dissolved matrix.

Once the sequences 5 of nucleotides have been extracted and purified, quantitative amplification is performed in step 12 by PCR using specific primers and specific fluorimetric probes. The specific primers enable the sequences 5 to be amplified, while the fluorimetric probes make it possible in real time to measure the quantity of amplified DNA.

PCR amplification requires the use of specific primers.

Thus, only a person having those specific primers available is capable of performing amplification.

The sequence 5 may be made in accordance with the characteristics described in patent application WO 00/61799, thus enabling quantitative PCR to be performed.

Naturally, the invention is not limited to the examples given above.

In particular, biochemical markers other than those described in international applications WO 94/04918 and WO 00/61799 can be used, and in particular it is possible to use molecular semaphores as described on pages 60 and 61 of the July 2000 issue of the journal "Sciences & Avenir".

Such semaphores comprise a DNA loop with a fluorescent molecule and a masked molecule grafted onto the ends thereof.

If the loop recognizes a complementary sequence on a strand of DNA, then it opens out and becomes fluorescent, otherwise it remains looped and does not emit light.

It is also possible to use natural double-strand DNA as the biochemical marker.

In which case, amplification can be performed without a specific primer.

The invention claimed is:

1. Paper comprising:

bodies having a largest dimension greater than 100 μm and being configured for an individual extraction out of the paper; and at least one biochemical marker carried by the bodies, wherein the at least one biochemical marker comprises at least one sequence of nucleotides.

2. Paper according to claim 1, wherein the largest dimension of said bodies lies in the range 1 mm to 10 mm.

3. Paper according to claim 1, wherein the bodies are fibers or fiber agglomerates.

4. Paper according to claim 3, in which the bodies are fibers, wherein the length of the fibers lies in the range 3 mm to 10 mm.

5. Paper according to claim 3, in which the bodies are fiber agglomerates constituting spots, wherein the spots are greater than 2 mm in diameter.

6. Paper according to claim 3, wherein the bodies are extruded fibers, the biochemical marker being mixed with an ingredient of the fibers prior to extrusion.

7. Paper according to claim 3, the bodies being fibers, wherein the fibers are viscose based.

8. Paper according to claim 1, wherein the bodies carrying the biochemical marker are colored.

9. Paper according to claim 1, wherein the bodies carrying the biochemical marker fluoresce in the infrared or the ultraviolet.

10. Paper according to claim 1, wherein the bodies carrying the biochemical marker fluoresce in the visible and are observed under specific excitation through a filter.

11. Paper according to claim 1, wherein the bodies carrying the biochemical marker also contain fluorescent microspheres.

12. Paper according to claim 1, wherein the bodies carrying the biochemical marker are radioactive or magnetic or present properties of electromagnetic resonance at particular frequencies and/or change appearance depending on angle of observation or under the action of an excitation source.

13. Paper according to claim 12, wherein the bodies carrying the biochemical marker are fibers that are flourescent or thermochormic or photochromic.

14. Paper according to claim 1 ,wherein the distribution of the bodies carrying the biochemical marker in the papermaking mass is random.

15. Paper according to claim 1, wherein the bodies carrying the biochemical marker are confined in a strip.

16. Paper according to claim 1, wherein the density of bodies carrying the biochemical marker is less than ten bodies per $dm^2$ of paper when the distribution of bodies is random and includes all of the paper, or less than ten bodies per linear dm when the bodies are confined in a strip.

17. Paper according to claim 16, wherein the at least one sequence is a single strand sequence.

18. Paper according to claim 16, wherein the at least one sequence comprises 70 to 110 nucleotides.

19. Paper according to claim 1, wherein the biochemical marker is constituted by sequences of nucleotides.

20. Paper according to claim 19, wherein each body includes more than $10^7$ sequences.

21. Paper according to claim 19, wherein the biochemical marker comprises at least $10^5$ sequences of nucleotides.

22. Paper according to claim 1, wherein the biochemical marker is bound to a binder.

23. Paper according to claim 22, wherein the binder is selected from azidine-cured polyurethane or a styrene-acrylate copolymer cured with melamine-formol.

24. A method of manufacturing paper, the method comprising:

incorporating bodies in the mass papermaking fiber during the process of making the paper, the bodies having a largest dimension greater than 100 μm and carrying at least one biochemical marker comprising at least one sequence of nucleotides.

25. A method according to claim 24, wherein the bodies carrying the biochemical marker are mixed in a bath used during treatment of the papermaking mass.

26. A method according to claim 24, wherein the biochemical marker is initially introduced into a master mixture used for making the fibers by extrusion.

27. A method according to claim 26, wherein the fibers are made by extruding polypropylene.

28. A method according to claim 24, wherein the fibers are made by spinning viscose.

29. A method according to claim 24, wherein the bodies comprise fibers or fiber agglomerates.

30. Paper according to claim 11, wherein the flourescent microspheres are based on inorganic material.

31. Paper according to claim 12, wherein the excitation source is a source of radiation.

* * * * *